US011199082B2

(12) United States Patent
DeVries

(10) Patent No.: US 11,199,082 B2
(45) Date of Patent: Dec. 14, 2021

(54) SENSOR INTEGRATED DRILL BIT AND METHOD OF DRILLING EMPLOYING A SENSOR INTEGRATED DRILL BIT

(71) Applicant: Halliburton Energy Services, Inc., Houston, TX (US)

(72) Inventor: Thomas DeVries, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/863,879

(22) Filed: Apr. 30, 2020

(65) Prior Publication Data

US 2021/0340855 A1 Nov. 4, 2021

(51) Int. Cl.

| | |
|---|---|
| ***E21B 44/02*** | (2006.01) |
| ***E21B 49/00*** | (2006.01) |
| ***E21B 10/42*** | (2006.01) |

(52) U.S. Cl.

CPC ..... *E21B 44/02* (2013.01); *E21B 10/42* (2013.01); *E21B 49/003* (2013.01)

(58) Field of Classification Search

CPC ..... E21B 45/00; E21B 10/00; E21B 10/62; E21B 44/00; E21B 47/00; E21B 47/12; E21B 47/26; E21B 49/006; G01V 2200/16; G01V 1/306; Y10T 29/49771

See application file for complete search history.

(56) References Cited

U.S. PATENT DOCUMENTS

| | | | | |
|---|---|---|---|---|
| 5,250,806 | A * | 10/1993 | Rhein-Knudsen | G01V 5/08 250/254 |
| 9,394,782 | B2 * | 7/2016 | DiGiovanni | E21B 10/567 |
| 2010/0038136 | A1 | 2/2010 | Trinh et al. | |
| 2011/0253457 | A1 * | 10/2011 | Shen | E21B 12/02 175/397 |
| 2013/0020130 | A1 | 1/2013 | Trinh et al. | |
| 2014/0008059 | A1 | 1/2014 | Macrae | |
| 2015/0247398 | A1 * | 9/2015 | Pelletier | E21B 7/00 175/41 |
| 2016/0053603 | A1 | 2/2016 | Israel et al. | |
| 2016/0319660 | A1 * | 11/2016 | DiGiovanni | E21B 10/567 |
| 2017/0044834 | A1 * | 2/2017 | Peters | E21B 17/1078 |
| 2017/0275989 | A1 | 9/2017 | Lakings et al. | |
| 2019/0360275 | A1 * | 11/2019 | Hough | E21B 10/42 |
| 2020/0011170 | A1 * | 1/2020 | Cao | E21B 10/55 |
| 2020/0095831 | A1 * | 3/2020 | Etebu | E21B 47/017 |
| 2020/0332652 | A1 * | 10/2020 | Sehsah | E21B 10/42 |

* cited by examiner

*Primary Examiner* — Daniel P Stephenson
(74) *Attorney, Agent, or Firm* — Benjamin Ford; Parker Justiss, P.C.

(57) ABSTRACT

The disclosure provides a drill bit having integrated sensors, a penetration monitoring system for a subterranean drill bit, and a method of drilling a borehole in a subterranean formation. In one example, the drill bit includes multiple blades configured to penetrate a subterranean formation, and at least one sensor, is integrated with the drill bit, that is configured to collect penetration data in real time during operation of the drill bit. An example of the method includes operating a drill bit in a borehole, receiving penetration data from the operating drill bit, wherein the penetration data is from at least one sensor integrated with the drill bit, and modifying drilling parameters of the drill bit based on the penetration data. The method can be for an open hole sidetrack.

22 Claims, 5 Drawing Sheets

SENSOR INTEGRATED DRILL BIT AND METHOD OF DRILLING EMPLOYING A SENSOR INTEGRATED DRILL BIT

BACKGROUND

The oil and gas industry often uses directional drilling to direct a drill bit to a desired subterranean target zone. During the drilling process, the trajectory of the drill bit to the target zone can get off course. To correct, the solution often involves pulling the drill string completely out of the borehole, adding cement to the borehole to provide a firm base, and then start re-drilling in the right direction from the cement base. This process of pulling out the drill string and allowing the cement to sufficiently cure, providing a solid base for re-drilling can easily take up to 48 hours.

Another option to correct the trajectory is an open hole sidetrack. With an open hole sidetrack, instead of pulling the drill string completely out of the borehole, the drill bit is pulled back to a desired location in the borehole where drilling can begin to correct the trajectory to the target zone. With an open hole sidetrack, the drill bit needs a good angle in the side of the borehole at the desired location to drill into the subterranean formation, and not follow the path of least resistance, which is the existing borehole. To protect against following the path of least resistance, a script of tedious instructions are typically followed that assists in orienting the bit in the correct direction, and then slowly rotating the bit. The script, for example, typically depends on the type of formation and can instruct to proceed at a rate of one foot per hour for the first five feet, then three to five feet per hour for five feet, followed by five to eight feet per hour for an additional five feet. An open hole sidetrack can take up to twenty hours to successfully escape the old borehole and enter into a new borehole heading in a different direction. Success of an open hole sidetrack usually depends on the ability to escape the old borehole, but a too aggressive process can result in a failed open hole sidetrack. Often, an open hole sidetrack is restarted if a ledge created by the process is broken.

SUMMARY

In one aspect, the disclosure provides a drill bit for penetrating subterranean formations. In one example, the drill bit includes: (1) multiple blades configured to penetrate a subterranean formation, and (2) at least one sensor configured to collect penetration data in real time during operation of the drill bit, wherein the at least one sensor is integrated with the drill bit.

In another aspect, the disclosure provides a penetration monitoring system for a subterranean drill bit. In one example, the penetration monitoring system includes: (1) an interface configured to receive penetration data from a drill bit operating within a borehole, and (2) a monitoring processor configured to generate drilling parameters for the drill bit based on the penetration data.

In yet another aspect, the disclosure provides a method of drilling a borehole in a subterranean formation. In one example, the method includes: (1) operating a drill bit in a borehole, (2) receiving penetration data from the operating drill bit, wherein the penetration data is from at least one sensor integrated with the drill bit, and (3) modifying drilling parameters of the drill bit based on the penetration data.

BRIEF DESCRIPTION

Reference is now made to the following descriptions taken in conjunction with the accompanying drawings, in which.

DETAILED DESCRIPTION

Figure 1A:
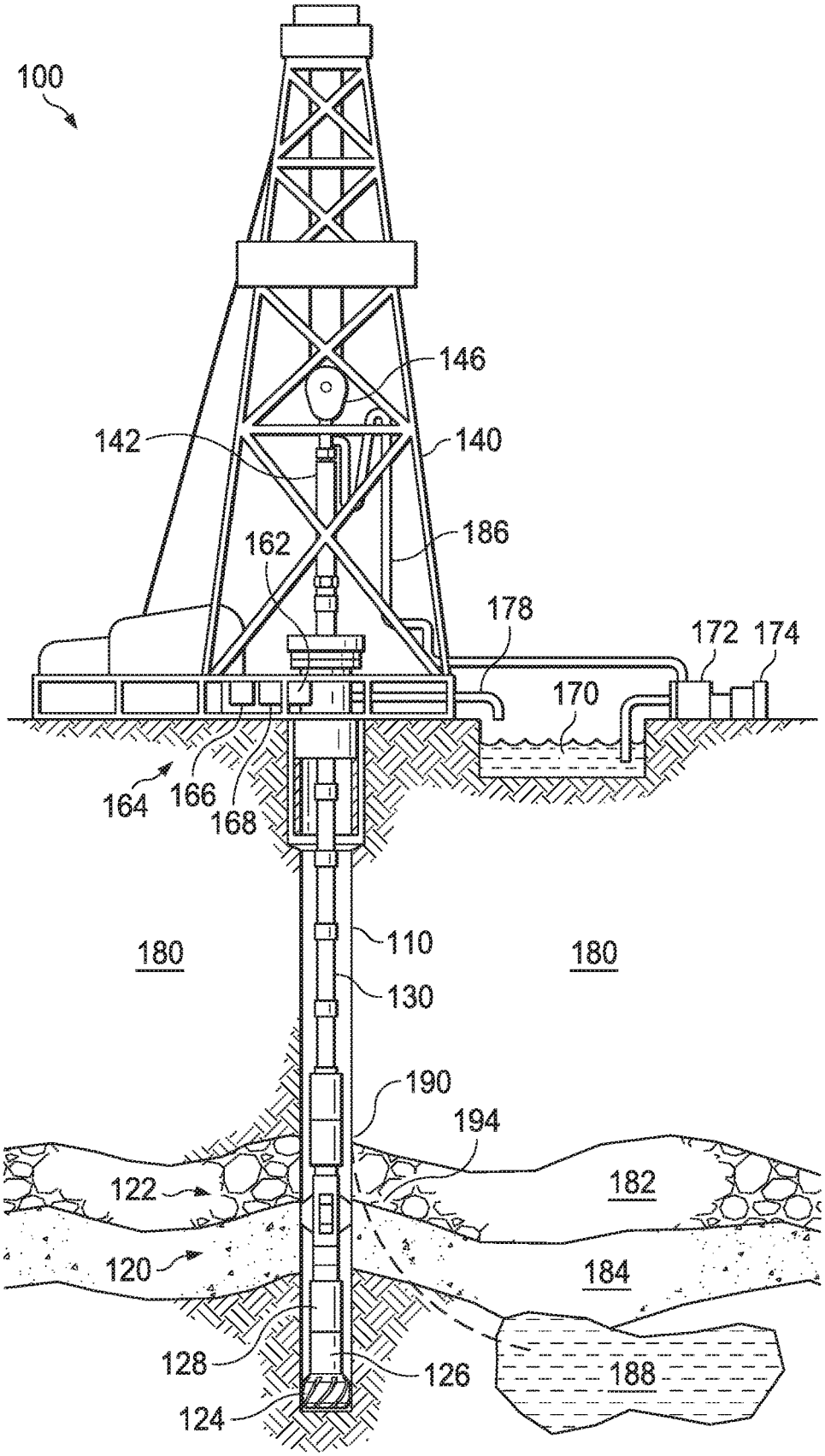
FIG. 1A illustrates an example of a well system that performs formation drilling and employs a sensor integrated drill bit (SIDB) constructed according to the principles of the disclosure.

When performing an open hole sidetrack, determining that the drill bit is actually creating a new borehole through the subterranean formation is important. Accordingly, the disclosure provides a drill bit with integrated sensors that provide real time information to an operator to indicate penetration of the drill bit into a subterranean formation. The penetration data is provided to the surface to assist the operator in performing, for example, an open hole sidetrack by indicating whether the drill bit is contacting the sidewall of the borehole (i.e., the subterranean formation) instead of the borehole. The penetration data will allow operators to have a better understanding of the progress of an open hole sidetrack operation, which would otherwise not be made available. The penetration data is collected and provided to the surface in real time to assist the operator in directing the drilling process. The penetration data can be provided from the drill bit to the surface via a conventional telemetry system employed in a borehole. The penetration data can be provided to a penetration monitoring system that determines, based on the penetration data, penetration progress of the drill bit into the subterranean formation. Based on the penetration progress, drilling parameters for controlling the drilling process can be determined and/or modified. The drilling parameters include, for example, weight on bit (WOB), revolutions per minute (RPM), and flow rate, such as gallons per minute (GPM). A method of controlling a drilling process, such as an open hole sidetrack, employing the penetration data from a drill bit is also disclosed.

Penetration data is real time sensor data or measurements collected from one or more sensors integrated with a drill bit. The one or more sensors can be a vibration sensor, a strain gauge, a resistivity sensor, a gamma sensor, a torque sensor, or another type of sensor that can be integrated with the drill bit and provide real time data from the drill bit as the drill bit, for example, engages a subterranean formation. The penetration progress can be represented by an amount of cross section of the drill bit that has come in contact with the formation, the number of blades of the drill bit that are contacting the formation, a ledge thickness, or another parameter determined from the penetration data that represents real time progress of the bit into a formation. For example, the penetration data can be used to indicate the percentage of the face of the drill bit that is exiting an existing borehole and contacting a sidewall of the borehole. By monitoring the bit engagement, ledge thickness, cross-section percentage in to the formation, or another parameter representing penetration progress, drilling parameters can be optimized. The penetration progress allows a surface operator to adjust the drilling parameters with confidence to accelerate a drilling operation, such as the sidetracking process. The disclosed drill bit with one or more integrated sensors is referred to herein as a sensor integrated drill bit (SIDB). The one or more sensors of a SIDB can be integrated with a blade or blades of the drill bit.

FIG. 1A illustrates an example of a well system, generally designated 100, that performs formation drilling and employs a SIDB constructed according to the principles of the disclosure. The well system 100 can incorporate logging operations of a borehole 110 and surrounding subterranean formations while drilling. Well system 100 is configured to drive a bottom hole assembly (BHA) 120 positioned or otherwise arranged at the bottom of a drill string 130 extended into the earth 180 from derrick 140 arranged at the surface. Derrick 140 includes a kelly 142 and a traveling block 146 used to lower and raise the kelly 142 and drill string 130.

BHA 120 includes a tool string 122 and an SIDB 124 that is operatively coupled to the tool string 122. During operation, SIDB 124 penetrates the earth 180 and thereby creates borehole 110. BHA 120 provides directional control of SIDB 124 as it advances into the earth 180.

Fluid or "drilling mud" from a mud tank 170 may be pumped downhole using a mud pump 172 powered by an adjacent power source, such as a prime mover or motor 174. The drilling mud may be pumped from mud tank 170, through a stand pipe 176, which feeds the drilling mud into drill string 130 and conveys the same to the SIDB 124. The drilling mud exits one or more nozzles arranged in the SIDB 124 and in the process cools the SIDB 124. After exiting the SIDB 124, the mud circulates back to the surface via the annulus defined between the borehole 110 and the drill string 130, and in the process, returns drill cuttings and debris to the surface. The cuttings and mud mixture are passed through a flow line 178 and are processed such that a cleaned mud is returned down hole through the stand pipe 176 once again.

Tool string 122 can be semi-permanently mounted with various measurement tools (not shown) such as, but not limited to, measurement-while-drilling (MWD) and logging-while-drilling (LWD) tools, that may be configured to take downhole measurements of drilling conditions. For example, the tool string 122 can include a downhole tool 126 that collects logging data as the SIDB 124 extends the borehole 110 through subterranean formations 182, 184, of the earth 180.

In addition to the logging data that is collected, the SIDB 124 can collect penetration data while progressing through the subterranean formations 182, 184. The penetration data may be included with up-hole communications of logging or drilling parameters while the SIDB 124 is operating. For purposes of communication, a downhole telemetry transceiver 128 can be included in the BHA 120, either separately or as part of the tool string 122 or the downhole tool 126. Downhole telemetry transceiver 128 can transfer measurement data to a surface transceiver 162 and receive commands from the surface, such as for directing operation of the downhole tool 126. Mud pulse telemetry is one common telemetry technique for transferring tool measurements to surface receivers and receiving commands from the surface. Other telemetry techniques typically used in LWD or MWD systems can also be used. Downhole telemetry transceiver 128 can store logging data for later retrieval at the surface when the logging assembly is recovered. In addition to communicating the penetration data uphole in real time, the downhole telemetry transceiver 128 can also store the penetration data for analysis when the logging assembly is recovered. Another memory located downhole, such as with the downhole tool 126, can also be used to store the penetration data for later analysis.

At the surface, surface transceiver 162 can receive the penetration data from the downhole telemetry transceiver 128 and can communicate the penetration data to well controller equipment 164. Well controller equipment 164 includes one or more processors, storage mediums, input devices, output devices, software, and other computing components for operating the BHA 120 and drill string 130. For example, the well controller equipment 164 includes a drilling controller 166 that directs the drilling process of the borehole 110 by controlling drilling parameters of the SIDB 124. The drilling controller 166 can be a typical drilling controller that is used to control the drilling parameters of drill bits. Well controller equipment 164 also includes a penetration monitoring system 168 that can receive, store, and/or process the penetration data received from the SIDB 124 as described herein.

As noted above, sometimes a borehole is off-course and does not follow a desired trajectory to reach a target zone. In the illustrated example, the current trajectory of the SIDB 124 is off-course to reach target zone 188 and needs to be corrected, by for example, an open hole sidetrack. As such, the BHA 120 can be retracted up hole to a designated point, point 190, to start an open hole sidetrack to reach the target zone 188 along a corrected trajectory 194. The SIDB 124 can collect and provide the penetration data to the penetration monitoring system 168 in real time. The penetration monitoring system 168 can process the penetration data to determine penetration progress of the SIDB 124 with the side of the borehole 110 during the open hole sidetrack and provide drilling parameters to control the SIDB 124. The penetration monitoring system 168 can consider additional data along with the penetration data when determining the penetration progress. For example, the penetration monitoring system 168 can use formation characteristics of the subterranean formations 182 and 184 in addition to the penetration data. The penetration monitoring system 168 can also use feedback of the drilling parameters from the drilling controller 166, and physical parameters of the SIDB 124.

The penetration monitoring system 168 can automatically provide the drilling parameters to the drilling controller 166 that can then control the SIDB 124 based on the drilling parameters. The penetration monitoring system 168 can also provide the drilling parameters to a display for a human operator to use for controlling the SIDB 124. The display can be part of the well controller equipment 164, such as the drilling controller 166 of the penetration monitoring system 168.

Figure 1B:
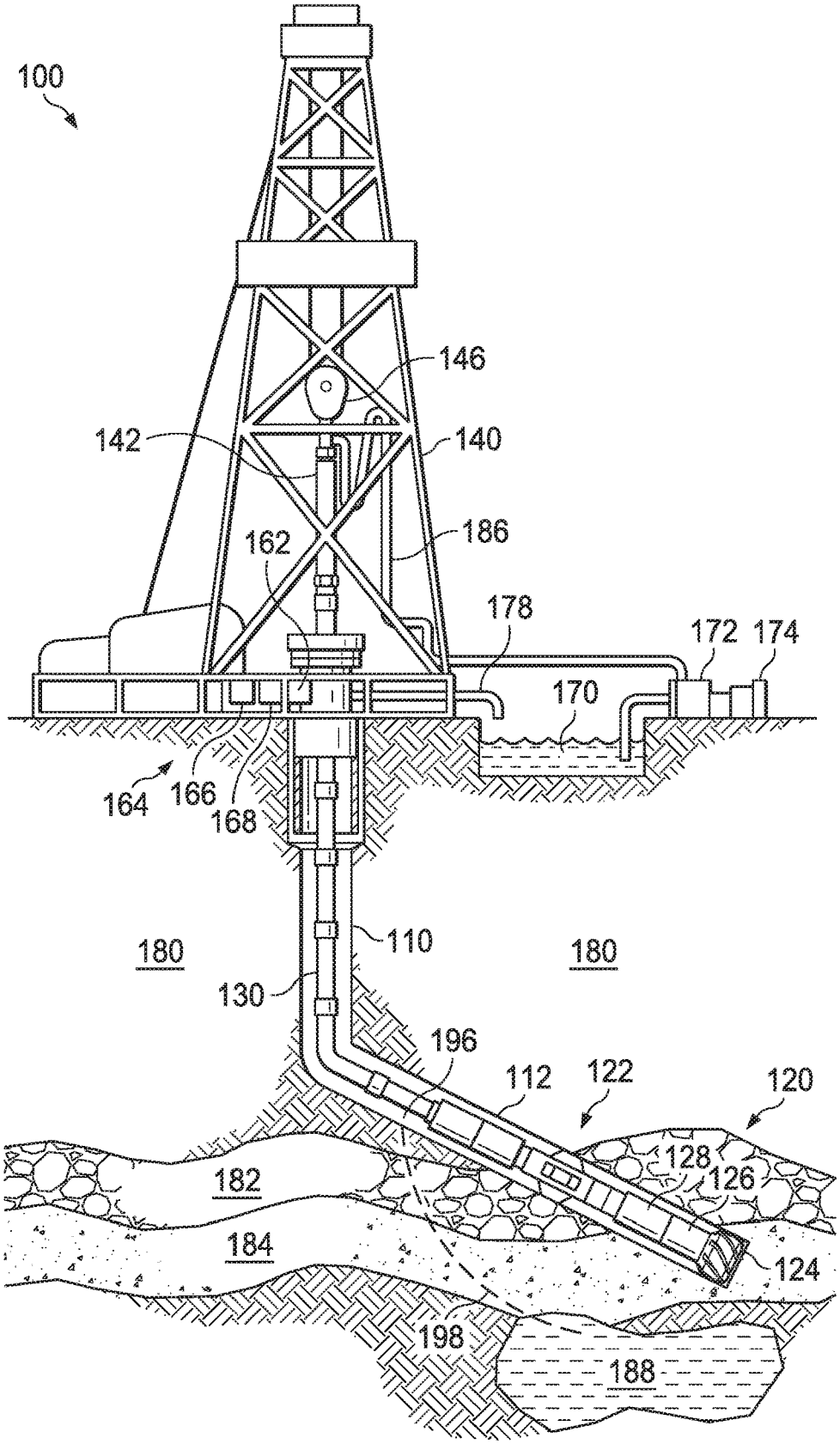
FIG. 1B illustrates the well system of FIG. 1A having a non-vertical section of the borehole and employing the SIDB in the non-vertical section according to the principles of the disclosure.

FIG. 1A depicts an onshore drilling operation. The features disclosed herein can also be used in offshore operations. Additionally, the borehole 110 is a vertical borehole. The features disclosed herein can also be equally well suited for use in boreholes having other orientations including horizontal boreholes, slanted boreholes, multilateral boreholes, and other borehole types. FIG. 1B provides one such example.

FIG. 1B illustrates the well system of FIG. 1A wherein the borehole 110 includes a non-vertical portion denoted as non-vertical section 112. The elements that are in both FIG. 1A and FIG. 1B are denoted with the same element numbers. The non-vertical section 112 can be drilled using directional drilling.

As with the borehole 110, the current trajectory of the SIDB 124 in the non-vertical section 112 is off-course to reach target zone 188 and needs to be corrected, by for example, an open hole sidetrack. As such, the BHA 120 can be retracted up hole to designated point 196, to start an open hole sidetrack to reach the target zone 188 along a corrected trajectory 198. As discussed above, the SIDB 124 can collect and provide penetration data to the penetration monitoring system 168 in real time when engaging the lower side of the non-vertical section 112 along the corrected trajectory 198. The penetration monitoring system 168 can process the penetration data to determine penetration progress of the SIDB 124 during the open hole sidetrack and provide drilling parameters to control the SIDB 124.

A conventional drill bit can be used for drilling the borehole 110. Before starting the open hole sidetrack, the BHA 120 can be retracted to the surface and the conventional drill bit can be replaced with the SIDB 124. The SIDB 124 can then be positioned to perform the open hole sidetrack. Once there is confidence that the SIDB 124 has penetrated the sidewall of the borehole 110 and that the trajectory is on the right path to the target zone 188, the SIDB 124 can then be replaced with the conventional drill bit. Several factors, including durability of the SIDB 124, location of the open hole sidetrack in the borehole 110, cost of retracting and replacing, etc., can be considered to determine when to use the SIDB 124 or the conventional drill bit. The penetration monitoring system 168 can provide penetration progress to assist in having confidence that the SIDB 124 has penetrated the sidewall and exited the borehole 110 along the correct trajectory. The penetration monitoring system 168 can consider additional data, such as drilling parameter feedback and formation characteristics of the subterranean formations 182, 184, when determining the penetration progress. An example of a penetration monitoring system is provided in FIG. 2.

Figure 2:
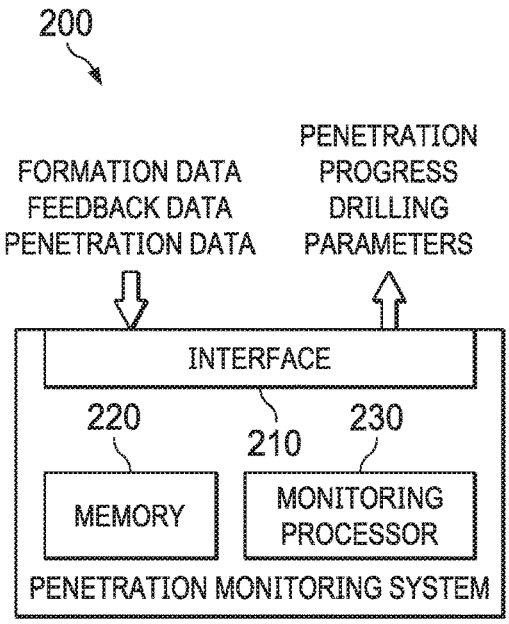
FIG. 2 illustrates a block diagram of an example of a penetration monitoring system constructed according to the principles of the disclosure.

FIG. 2 illustrates a block diagram of an example of a penetration monitoring system 200 constructed according to the principles of the disclosure. The penetration monitoring system 200 determines penetration progress based on penetration data from a SIDB operating in a borehole, such as borehole 110 of FIGS. 1A and 1B. The penetration monitoring system 168 of FIGS. 1A and 1B can be implemented as, or at least similarly to, the penetration monitoring system 200. The penetration monitoring system 200 can be implemented in one or more computing systems, for example, a well site controller, a reservoir controller, a data center, cloud environment, server, laptop, smartphone, tablet, and other computing systems. The computing system can be located a distance from the reservoir, such as in a data center, cloud environment, or corporate location, and communicate via a communications network. The computing system can also be located at or proximate the borehole. For example, the penetration monitoring system 200 can be located at the surface of a borehole, such as with the well controller equipment 164 of FIG. 1A or 1B.

The penetration monitoring system 200, or at least a portion thereof, can be implemented as an application, a code library, dynamic link library, function, module, other software implementation, or combinations thereof. In some aspects, the penetration monitoring system 200 or a portion thereof can be implemented in hardware, such as a ROM, or other hardware implementation. The penetration monitoring system 200 can be implemented partially as a software application and partially as a hardware implementation. The penetration monitoring system 200 includes an interface 210, a memory 220, and a processor 230. Each of the components of the penetration monitoring system 200 can be communicatively coupled via conventional connections.

The interface 210 is configured to communicate, i.e., transmit and receive, data. As such, the interface 210 include the necessary circuitry, components, firmware, software, etc., to transmit and receive data. The interface 210 can be a conventional interface associated with processors or controllers that communicate data according to different protocols, such as industry protocols used for communicating data between equipment in the oil and gas industry. The interface 210 can be configured to communicate via a communications network when remotely located from the borehole. The communications network can be a conventional communications network that communicates data according to standard protocols.

The interface 210 is configured to receive real time data, such as penetration data from a SIDB operating downhole and feedback data from a drilling controller. The interface 210 can receive additional data that corresponds to the borehole and surrounding subterranean formations. The interface 210 can also receive data from previous drilling operations at various boreholes. The data can be historical data generated from multiple previous operations that can be employed by the monitoring processor 230 for determining penetration progress and/or drilling parameters. In addition to receiving the different types of data, processing results of the monitoring processor 230 can also be transmitted via the interface 210. For example, drilling parameters can be transmitted from the penetration monitoring system 200 via the interface 210 to a drilling controller.

The memory 220 is a non-transitory computer readable medium that is configured to store a series of operating instructions that direct the operation of the monitoring processor 230 when initiated, including code representing the algorithms for determining penetration progress from at least the penetration data. The memory 220 can also be configured to store additional data associated with the borehole, such as the formation data, and other information, such as modeling or historical data, which can be used by the monitoring processor 230 when determining penetration progress and/or drilling parameters.

The monitoring processor 230 includes the necessary logic to communicate with the interface 210 and the memory 220 and perform the functions described herein to determine penetration progress and provide drilling parameters for the SIDB. As such, the monitoring processor 230 can implement the analysis, equations, and algorithms as described herein utilizing the penetration data to calculate the penetration progress and determine drilling parameters.

The monitoring processor 230 receives the penetration data and determines a penetration progress based thereon. The penetration progress can be provided, for example, as a ledge thickness or a percentage of contact with a formation. Sensors integrated with the SIDB can indicate when a blade is contacting a formation, i.e., blade contact. Different types and different combinations of sensors can be used, such as resistivity sensors that collect the resistance signature of the formation when contacted. For example, a SIDB can have four blades that each have a resistivity sensor. The monitoring processor 230 can receive resistivity data from each of the sensors and determine, based on the resistivity measurements, that only one blade is contacting the formation at a specific point in time during a revolution. For example, one resistivity measurement can correspond to the resistivity of a formation and the other three resistivity measurements can correspond to drilling fluid, concrete, or other components within the existing borehole. In this scenario, the monitoring processor 230 can indicate the penetration progress as 25 percent of contact per revolution.

The monitoring processor 230 can further employ other known parameters of the SIDB, such as the location of the sensors on the blades, and the contact surface of the SIDB to provide a penetration progress into the formation, such as 10 percent of the SIDB face is contacting the formation. Regardless of how the penetration progress is determined and presented, drilling parameters can be provided based thereon and adjusted as the penetration progress changes. For example, the face of the SIDB contacting the formation can increase from 10 percent to 45 percent. As such, the drilling parameters, such as WOB, can be changed based on the SIDB progressing into the formation.

Figure 3:
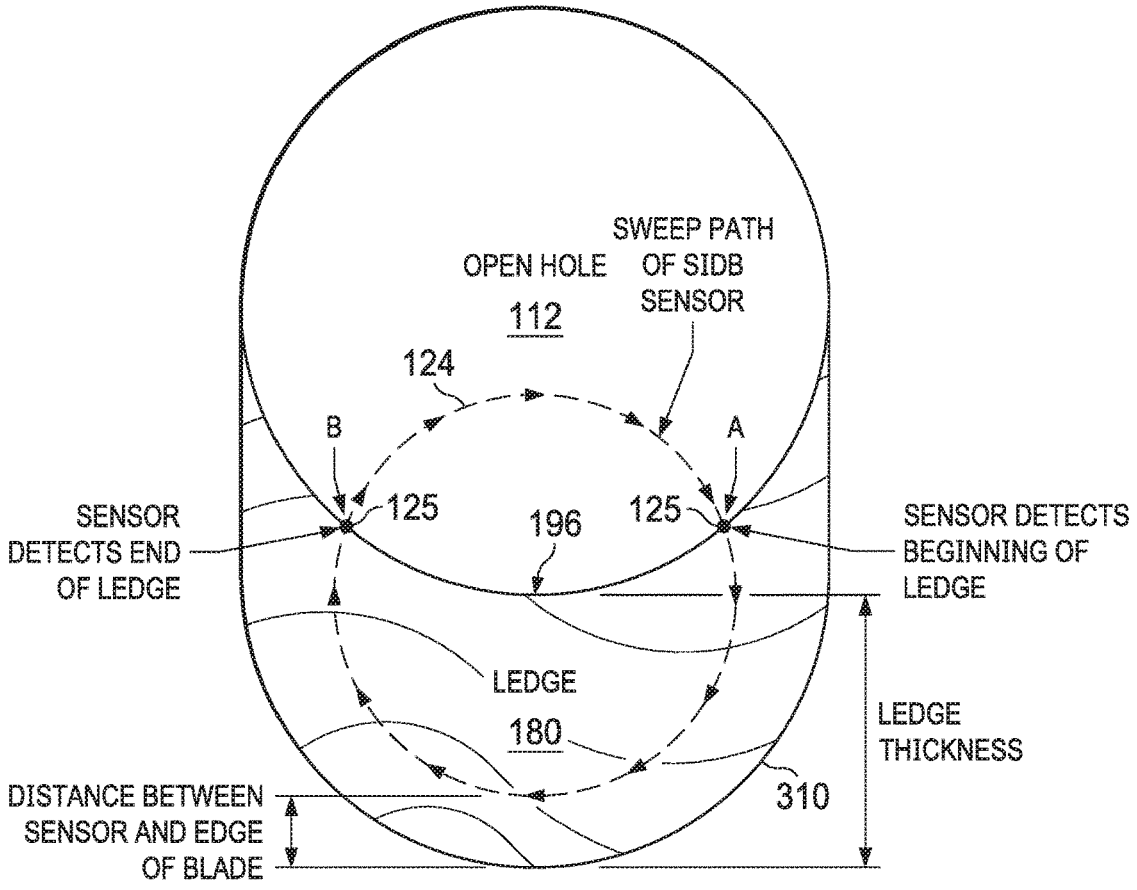
FIG. 3 illustrates an example of a SIDB penetrating the sidewall of a borehole and creating a ledge in the surrounding formation carried out according to the principles of the disclosure.

The monitoring processor 230 can also consider additional data, such as feedback data from the drilling parameters and historical data from similar formation or boreholes, to either determine the penetration progress, determine the drilling parameters, or both. The monitoring processor 230 can continuously learn from the various data that is received, including the formation data, downhole temperature, and the type of mud that is being used. In addition to possible historical data that is received, the monitoring processor 230 can continuously learn based on the received data and provide different modeling scenarios to generate penetration progress and optimal drilling parameters. Future modeling can be enhanced by matching the penetration data collected by the SIDB with the LWD or MWD data collected by a tool string following the SIDB. Historical data from other drilling operations can include the enhanced modelling. FIG. 3 provides an illustration of collecting penetration data employing a SIDB.

Figure 4:
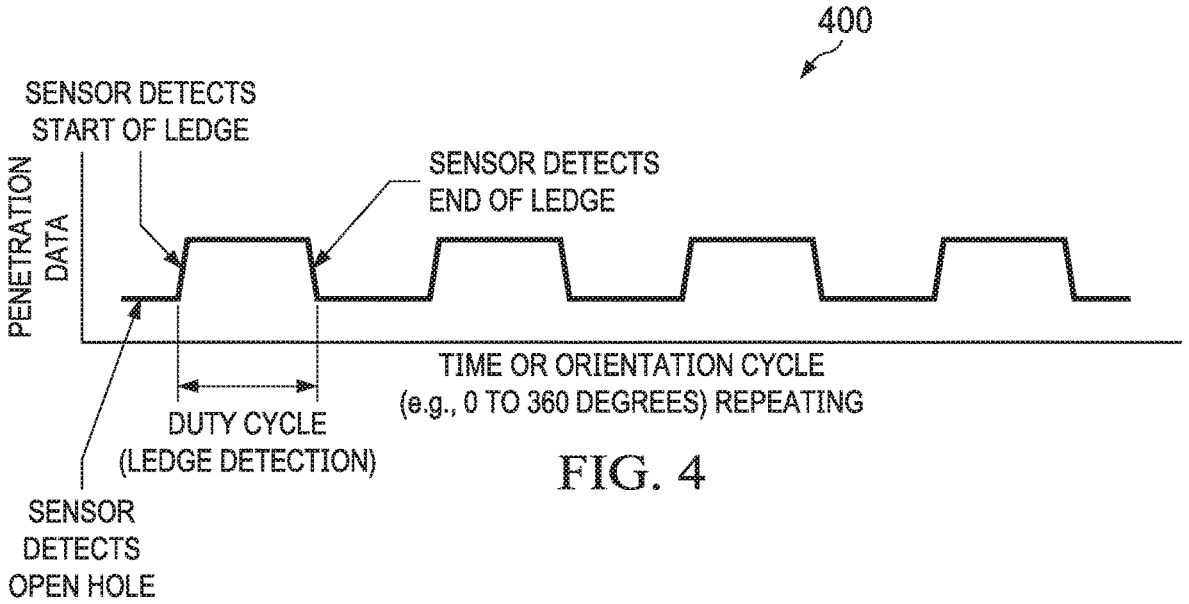
FIG. 4 illustrates a graph representing the penetration data collected by the sensor of FIG. 3 as the SIDB rotates to form the ledge.

FIG. 3 and FIG. 4 illustrate examples of collecting penetration data from a SIDB performing an open hole sidetrack and employing the collected data to determine penetration progress. Both FIGS. 3 and 4 refer to the FIG. 1B but the examples provided from FIG. 3 and FIG. 4 can be applied to various types of boreholes, regardless the orientation.

FIG. 3 illustrates an example of a SIDB penetrating the sidewall of a borehole and creating a ledge in the surrounding formation carried out according to the principles of the disclosure. The SIDB 124 and the non-vertical section 112 of FIG. 1B will be used as an example. As noted above, the SIDB 124 can include one or more sensors to collect penetration data to send to a monitoring processor, such as monitoring processor 230. For FIG. 3, a single sensor 125 is used as an example as it rotates with the SIDB 124. Additional sensors can be similarly used to collect penetration data.

FIG. 3 shows a cross section of the non-vertical section 112 at the designated point 196 to start an open hole sidetrack to reach the target zone 188 along the corrected trajectory 198. The face of the SIDB 124 is shown as it leaves the open hole of the non-vertical section 112 and creates a ledge 310 in the earth 180. The sensor 125 is shown as the SIDB 124 sweeps into the ledge 310 being created by the side track and then rotates out into the open hole non-vertical section 112. The sensor 125 detects the beginning of the ledge 310 at point A and the end of the ledge 310 at point B as the SIDB 124 rotates. Depending on the type of sensor, the sensor 125 can detect the beginning and end of the ledge 310 in various ways. For example, the sensor 125 can be a vibration sensor, a strain gauge, a resistivity sensor, a gamma sensor, or a torque sensor, and entering and leaving the ledge 310 can be determined by a change in vibration, strain, resistivity, radiation, or torque. The penetration data, i.e., the measurements collected by the sensor 125, is transmitted uphole and employed to determine penetration progress, such as ledge thickness. FIG. 4 illustrates a graph based on the penetration data of the sensor 125 that can be used to determine penetration progress.

FIG. 4 illustrates a graph 400 representing the penetration data collected by the sensor 125 of FIG. 3 as the SIDB 124 rotates to form the ledge 310. The y-axis of the graph 400 is the penetration data and the x-axis is time. The graph 400 shows the duty cycle of the sensor 125 as the sensor 125 sweeps into the ledge 310 being created by the SIDB 124 and then rotates out into the open hole of the non-vertical section 112. The duty cycle is a cyclical function represented by a square wave in the graph 400 where the width of the square represents how much of the arc length of rotation of the sensor 125 is sensing a near bit formation of the earth 180 versus the part of the arc length of the rotating sensor 125 that is not sensing the earth 180. For example, as the SIDB 124 rotates there is a portion of the rotation where the sensor 125 starts sensing the lateral formation ledge 310 (at point A) and a portion where the sensor 125 stops sensing the lateral formation ledge 310 (at point B). The length of the arc where the formation ledge 310 is detected can be used to determine the actual maximal depth, or thickness, of the ledge 310 and how much of the SIDB 124 is still sitting in the open hole non-vertical section 112. For example, a monitoring processor can determine the arc length from the penetration data represented by graph 400, relate the arc length to the side of the non-vertical section 112 at point A and B, and knowing the circumference of the SIDB 124, determine the ledge thickness based on the distance from the side of the non-vertical section 112 to the edge of the SIDB 124. The circumference and other physical parameters of the SIDB 124 can be received as inputs by the monitoring processor. An example of another physical parameter is the distance between sensor 125 and the edge of the blade of the SIDB 124 that engages in the earth 180. The monitoring processor could generate a circular plot based on the graph 400 that graphically represents the penetration data, which can be the ledge thickness in this example.

An orientation sensor or sensors can also be used to collect data and provide it to the monitoring processor to know the orientation of the SIDB 124 as it is being rotated. The orientation data can be used to orient positions along the circumference of the sweep of the SIDB 124. For example, zero degrees along the 360 degree sweep circumference can be set to the high side of the SIDB 124 and 180 degrees can be set at the low side of the SIDB 124, which corresponds to the further penetration into the ledge 310 in FIG. 3. The orientation data can be collected with magnetic, gravity, or gyro based sensors or a combination thereof to track the orientation of the SIDB 124. The orientation sensor or sensors can be located further up the tool string 122 from the SIDB 24 as long as there is a rotational relationship that is known between the SIDB 124 and the one or more orientation sensors. A MWD probe can be positioned further up in the drill string 130 in a non-magnetic drill collar which is adequately spaced away from ferrous components such as the SIDB 124 and mud motors. The SIDB 124 can also include one or more orientation sensors. For example, instead of a magnetometer, the SIDB 124 can include an accelerometer, a gyro and/or gravity sensors on the x, y, z, axis to determine that the ledge 310 is being created at the correct location.

Penetration data can also be employed to determine the ledge thickness based on time duration rather than arc length. By using time instead of arc length, an initial arc position is measured under constant rotation and then time is used with the measured angular velocity to determine the position of the sensor over time. The amount of time that the SIDB 124 is engaging in the formation can then be calculated. Periodically the oriented position can be updated by the one or more orientation sensors so as to correct any misalignment errors.

Figure 5:
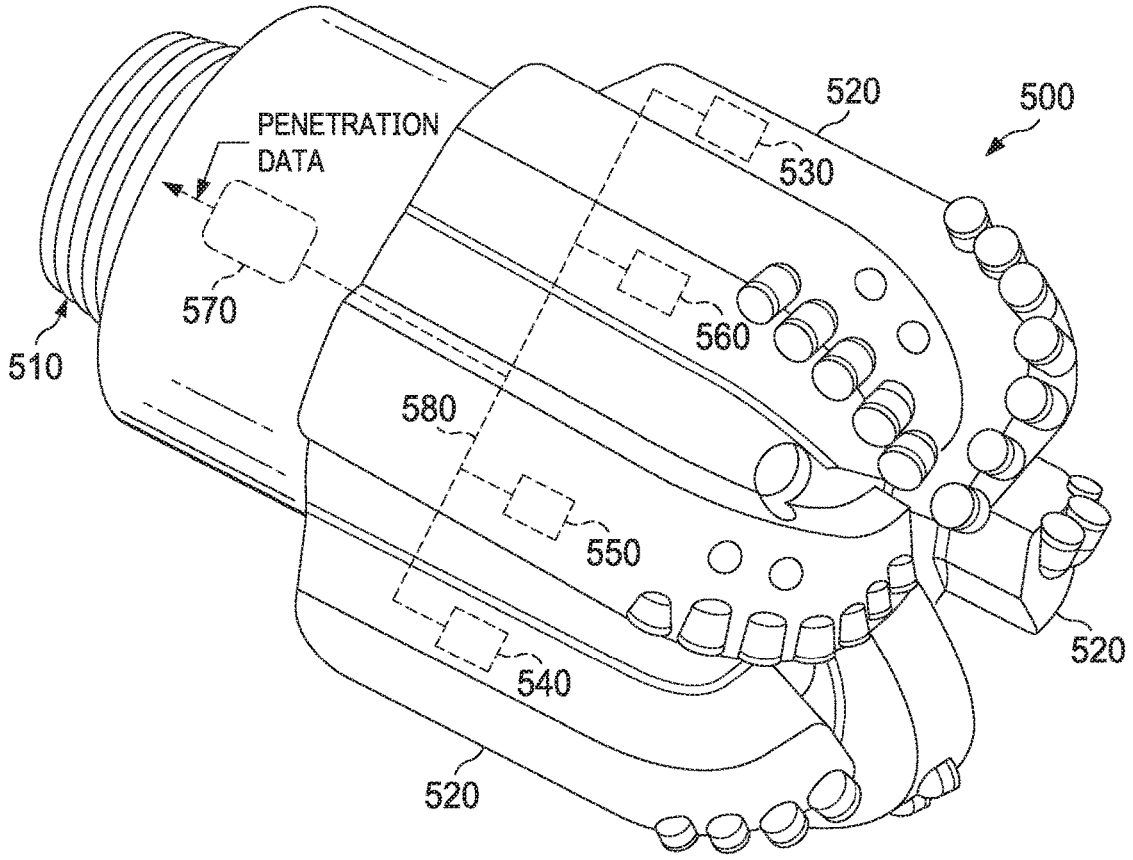
FIG. 5 illustrates a diagram of an example of a SIDB constructed according to the principles of the disclosure.

FIGS. 3-4 and the above discussion illustrate how penetration data can be collected by a SIDB and used to determine penetration progress. A monitoring processor can receive and process the penetration data to determine the penetration progress, such as the ledge thickness. In FIGS. 3-4, a single sensor is used as an example. FIG. 5 provides an example of a SIDB with multiple sensors.

FIG. 5 illustrates a diagram of an example of a SIDB 500 constructed according to the principles of the disclosure. The SIDB 500 is constructed for drilling in and through subterranean formations and can be used with directional drilling. The SIDB 500 can be used to provide real time penetration data to assist an operator in a drilling operation, such as an open hole sidetrack. The SIDB 500 includes a base 510, multiple blades, each designated by element 520, multiple sensors 530, 540, 550, 560, and a communications transceiver 570.

The base 510 attaches the SIDB 500 to a drill string, such as the drill string 130 of FIG. 1A or 1B. As illustrated in FIGS. 1A and 1B, the SIDB 500 can be coupled to the drill string 130 via a tool string 122. The SIDB 500 can be part of a BHA along with a tool string that is coupled to a drill string. The base can be a conventional base typically used in the industry.

The blades 520 are constructed to contact and drill through a subterranean formation. On one or more of the blades 520. The sensors 530, 540, 550, 560, are integrated with one or more of the blades. The SIDB 500 includes five blades, however, the number of blades can vary for different types of SIDB's. One or more of the sensors 530, 540, 550, 560, can be molded with at least one of the blades 520 during manufacturing. The sensors 530, 540, 550, 560, can also be mechanically attached to the blades 520 via conventional methods.

The sensors 530, 540, 550, 560, collect penetration data while the SIDB 500 is operating. The sensors 530, 540, 550, 560, can be the same type of sensors or can be multiple types of sensors. For example, sensors 510 and 520 can be strain gauges that indicate the stress of each blade 520 in which they are attached. Sensor 530 can be a gamma sensor that collects the signature of a formation in which it contacts. Sensor 540 can be a resistivity sensor that collects the resistivity of the formation in which it contacts. All of the penetration data collected by the sensors 530, 540, 550, 560, is provided to the transceiver 570 via connections, generally denoted by element 580. The connections 580 can be conventional connections, wired or wireless, that connect the different sensors 530, 540, 550, 560, to the transceiver 570. The transceiver 570 receives the penetration data via the connections 580 and transmits the penetration data uphole. The transceiver 570 can send the penetration data to a downhole telemetry transceiver, such as the downhole telemetry transceiver 128 in FIG. 1A or 1B.

Figure 6:
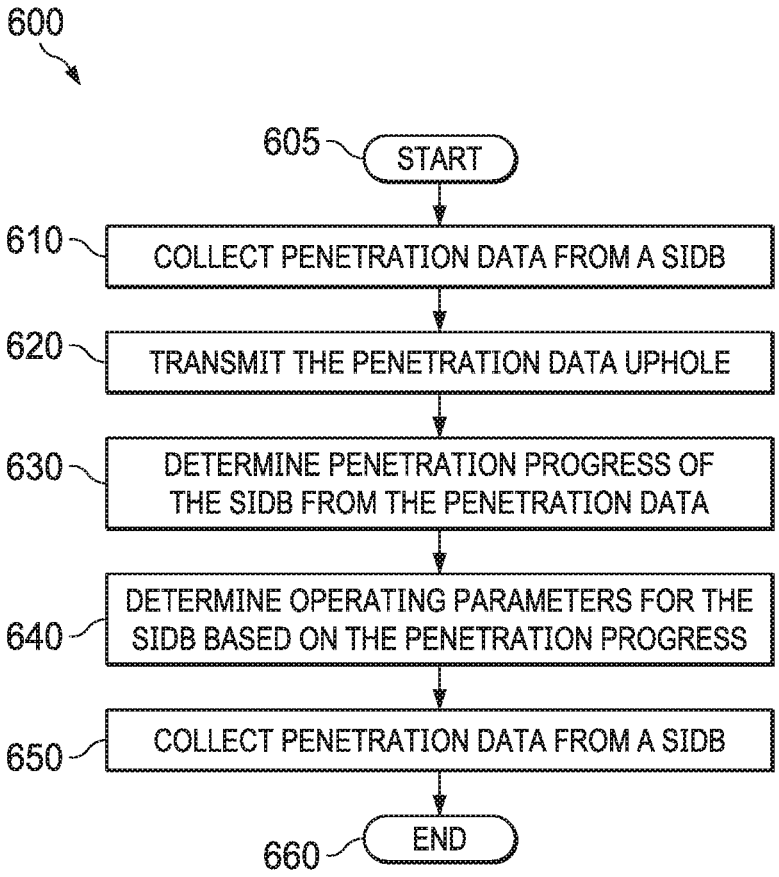
FIG. 6 illustrates a flow diagram of an example of a method of operating a SIDB carried out according to the principles of the disclosure.

FIG. 6 illustrates a flow diagram of an example of a method 600 of operating a SIDB carried out according to the principles of the disclosure. At least a portion of the method 600 can be carried out by a penetration monitoring system, such as the penetration monitoring system 200 of FIG. 2. The method 600 begins in a step 605.

In a step 610, penetration data is collected from a SIDB. The penetration data can be collected from one more sensors of the SIDB. The penetration data is collected in real time from the one or more sensors during operation of the SIDB in a borehole. The operation can be an open hole sidetrack. The penetration data can be measurements collected from one or more sensors, such as a vibration sensor, a strain gauge, a resistivity sensor, a gamma sensor, a torque sensor, or a combination thereof. One or more of the sensors can be designated as a primary sensor and one or more of the sensors can be designated as a secondary sensor.

The collected penetration data is transmitted uphole in a step 620. The penetration data can be communicated via conventional communication methods and devices employed within a borehole. A sensor or sensors integrated with the SIDB can communicate the collected penetration data to a downhole telemetry transceiver that then sends the penetration data uphole. The penetration data can be sent to a processor, such as the monitoring processor 230 of FIG. 2. The processor can be located proximate to or remote from the borehole.

Penetration progress of the SIDB is determined in a step 630 from the penetration data. The penetration progress can be ledge thickness that is determined based on arc length of or time duration of the SIDB engaging formation around the borehole. Additional information, such as orientation data, rotational velocity, location of sensor or sensors on the SIDB, circumference of the SIDB face, borehole data, formation data, etc. can also be employed with the penetration data to determine the penetration progress. A monitoring processor can process the received data and determine the penetration progress.

Drilling parameters for the SIDB are determined in a step 640 based on the penetration progress. The drilling parameters can be changed as the penetration progress changes. For example, if the ledge thickness increase then WOB and RPM can be increased since the SIDB is more engaged with the formation than the open hole. However, if the ledge thickness starts to decrease, then WOB and RPM can be decreased until the ledge thickness starts increasing. In addition to the penetration progress, other data, such as feedback of the current drilling parameters, can be employed when determining the drilling parameters. Other data, such as historical data, formation data, temperature, type of drilling mud, etc, can also be employed for determining both the penetration progress and the drilling parameters.

In a step 650, the SIDB is controlled based on the drilling parameters. The drilling parameters can be automatically provided to a drilling controller for operating the SIDB. The drilling parameters can also be sent to a display for an operator to employ in controlling the SIDB.

The steps of the method 600 can be repeated until the SIDB reaches a desired target, such as target zone 188 of FIGS. 1A and 1B. Accordingly, the SIDB can continually obtain penetration data while operating and send the penetration data uphole for processing to determine penetration progress. The method 600 then ends in a step 660.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Aspects Disclosed Herein Includes:

A. A drill bit for penetrating subterranean formations, comprising (1) multiple blades configured to penetrate a subterranean formation, and (2) at least one sensor configured to collect penetration data in real time during operation of the drill bit, wherein the at least one sensor is integrated with the drill bit.

B. A penetration monitoring system for a subterranean drill bit, comprising (1) an interface configured to receive penetration data from a drill bit operating within a borehole, and (2) a monitoring processor configured to generate drilling parameters for the drill bit based on the penetration data.

C. A method of drilling a borehole in a subterranean formation, comprising (1) operating a drill bit in a borehole, (2) receiving penetration data from the operating drill bit, wherein the penetration data is from at least one sensor integrated with the drill bit, and (3) modifying drilling parameters of the drill bit based on the penetration data.

Each of aspects A, B and C can have one or more of the following additional elements in combination. Element 1: wherein the at least one sensor is integrated with one of the multiple blades. Element 2: wherein the at least one sensor is selected from the group of sensors consisting of: a vibration sensor, a strain gauge, a resistivity sensor, a gamma sensor, and a torque sensor. Element 3: wherein the drill bit includes multiple integrated sensors configured to collect the penetration data. Element 4: wherein at least some of the multiple integrated sensors are integrated with different ones of the multiple blades. Element 5: wherein the multiple integrated sensors include different types of sensors. Element 6: further comprising a transceiver. Element 7: wherein the interface is further configured to receive feedback from a drilling controller and the monitoring processor is further configured to generate the drilling parameters based on the feedback. Element 8: wherein the drilling parameters include at least one of weight on bit, revolutions per minute, and flow rate. Element 9: wherein the penetration data is collected from at least one sensor integrated with the drill bit that is selected from the group of sensors consisting of: a vibration sensor, a strain gauge, a resistivity sensor, a gamma sensor, and a torque sensor. Element 10: wherein the processor is configured to determine penetration progress from the penetration data. Element 11: wherein the processor if further configured to determine the drilling parameters based on the penetration progress. Element 12: wherein the penetration progress is provided as a percentage of blade contact of the drill bit. Element 13: wherein the penetration progress is provided as a ledge thickness. Element 14: wherein the processor employs the penetration data to determine an arc length representing engagement of the drill bit in a subterranean formation adjacent the borehole, and employs the arc length to determine the ledge thickness. Element 15: wherein the operating is for an open hole sidetrack in the borehole. Element 16: further comprising determining, from the penetration data, a penetration progress of the drill bit into a side of the borehole, and modifying the drilling parameters based on the penetration progress. Element 17: further comprising determining the penetration progress based on physical parameters of the drill bit. Element 18: wherein the penetration data is from multiple sensors integrated with more than one blade of the drill bit. Element 19: further comprising transmitting the penetration data uphole during the operating.

What is claimed is:

1. A drill bit for penetrating subterranean formations, comprising:

multiple blades configured to penetrate a subterranean formation; and at least one sensor configured to collect penetration data in real time during operation of the drill bit, wherein the at least one sensor is integrated with the drill bit and the penetration data indicates a beginning of a ledge and an end of the ledge during the operation of the drill bit.

2. The drill bit as recited in claim 1, wherein the at least one sensor is integrated with one of the multiple blades.

3. The drill bit as recited in claim 1, wherein the at least one sensor is selected from the group of sensors consisting of:

a vibration sensor,
a strain gauge,
a resistivity sensor
a gamma sensor, and
a torque sensor.

4. The drill bit as recited in claim 1, wherein the drill bit includes multiple integrated sensors configured to collect the penetration data.

5. The drill bit as recited in claim 4, wherein at least some of the multiple integrated sensors are integrated with different ones of the multiple blades.

6. The drill bit as recited in claim 5, wherein the multiple integrated sensors include different types of sensors.

7. The drill bit as recited in claim 1, further comprising a transceiver.

8. A penetration monitoring system for a subterranean drill bit, comprising:

an interface configured to receive penetration data from a drill bit operating within a borehole; and a monitoring processor configured to generate drilling parameters for the drill bit based on the penetration data, wherein the processor is configured to determine penetration progress from the penetration data and the penetration progress is provided as a thickness of a ledge.

9. The penetration monitoring system as recited in claim 8, wherein the interface is further configured to receive feedback from a drilling controller and the monitoring processor is further configured to generate the drilling parameters based on the feedback.

10. The penetration monitoring system as recited in claim 8, wherein the drilling parameters include at least one of weight on bit, revolutions per minute, and flow rate.

11. The penetration monitoring system as recited in claim 8, wherein the penetration data is collected from at least one sensor integrated with the drill bit that is selected from the group of sensors consisting of:

a vibration sensor,
a strain gauge,
a resistivity sensor,
a gamma sensor, and
a torque sensor.

12. The penetration monitoring system as recited in claim 8, wherein the interface is further configured to receive formation data and the monitoring processor is further configured to generate the drilling parameters based on the formation data.

13. The penetration monitoring system as recited in claim 8, wherein the processor if further configured to determine the drilling parameters based on the penetration progress.

14. The penetration monitoring system as recited in claim 8, wherein the penetration progress is further provided as a percentage of blade contact of the drill bit.

15. The penetration monitoring system as recited in claim 8, wherein the penetration data indicates a beginning and an end of the ledge.

16. The penetration monitoring system as recited in claim 8, wherein the processor employs the penetration data to determine an arc length representing engagement of the drill bit in a subterranean formation adjacent the borehole, and employs the arc length to determine the ledge thickness.

17. A method of drilling a borehole in a subterranean formation, comprising:

operating a drill bit in a borehole;

receiving penetration data from the operating drill bit, wherein the penetration data is from at least one sensor integrated with the drill bit;

determining penetration progress from the penetration data and providing the penetration progress as a ledge thickness; and modifying drilling parameters of the drill bit based on the penetration progress.

18. The method as recited in claim 17, wherein the operating is for an open hole sidetrack in the borehole.

19. The method as recited in claim 18, wherein the penetration progress is of the drill bit into a side of the borehole.

20. The method as recited in claim 17, further comprising determining the penetration progress based on physical parameters of the drill bit.

21. The method as recited in claim 17, wherein the penetration data is from multiple sensors integrated with more than one blade of the drill bit.

22. The method as recited in claim 17, further comprising transmitting the penetration data uphole during the operating.

* * * * *